US007321344B2

(12) United States Patent
Sekii

(10) Patent No.: US 7,321,344 B2
(45) Date of Patent: Jan. 22, 2008

(54) PLASMA DISPLAY DEVICE AND METHOD OF REDUCING INTERFERENCE TO RADIO-BROADCASTING WAVES, CAUSED BY ELECTROMAGNETIC WAVES DERIVED FROM PLASMA DISPLAY DEVICE

(75) Inventor: Yoshizumi Sekii, Tokyo (JP)

(73) Assignee: Pioneer Corporation, Tokyo (JP)

( * ) Notice: Subject to any disclaimer, the term of this patent is extended or adjusted under 35 U.S.C. 154(b) by 643 days.

(21) Appl. No.: 10/838,199

(22) Filed: May 5, 2004

(65) Prior Publication Data

US 2004/0239591 A1 Dec. 2, 2004

(30) Foreign Application Priority Data

May 7, 2003 (JP) ..... 2003-128857

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS 6,037,917 A * 3/2000 Kawakami ..... 345/63
6,466,187 B1 * 10/2002 Moon ..... 345/63

FOREIGN PATENT DOCUMENTS

JP 10-149136 6/1998
JP 2000-338932 A 12/2000

OTHER PUBLICATIONS

Korean Patent Office Action.

* cited by examiner

*Primary Examiner*—Amr A. Awad
*Assistant Examiner*—Tom V Sheng
(74) *Attorney, Agent, or Firm*—Sughrue Mion, Pllc.

(57) ABSTRACT

A plasma display device includes a plasma display panel, and a driving pulse generator which generates pulses for driving the plasma display panel, and a memory storing data necessary for generating the pulses each having a frequency identical with one of a plurality of predetermined frequencies. The driving pulse generator generates the pulses each having an appropriate frequency associated with each of regions in which the plasma display device is used. The appropriate frequency is a frequency which reduces interference to medium or short radio-casting wave by electromagnetic wave caused by the plasma display device.

11 Claims, 7 Drawing Sheets

PLASMA DISPLAY DEVICE AND METHOD OF REDUCING INTERFERENCE TO RADIO-BROADCASTING WAVES, CAUSED BY ELECTROMAGNETIC WAVES DERIVED FROM PLASMA DISPLAY DEVICE

BACKGROUND OF THE INVENTION

1. Field of the Invention

The invention relates to a plasma display device, and a method of reducing interference to radio-broadcasting waves, caused by electromagnetic waves derived from a plasma display device.

2. Description of the Related Art

A plasma display device displays imaged by radiating ultra-violet ray generated by gas discharged to fluorescent material to thereby excite the fluorescent material and cause the fluorescent material to emit light therefrom. A plasma display device is grouped into AC type in which an AC (Alternating Current) power supply is used and DC type in which a DC (Direct Current) power supply is used.

An AC type plasma display device is superior to a DC type one in brightness and a light-emission efficiency, and is simpler in structure and easier to be fabricated in a large size than a DC type one. Hence, an AC type plasma display device is used more broadly than a DC type one.

An AC type plasma display device is further grouped into various structures. Among them, a three-electrode surface-discharge type AC plasma display panel is in particular broadly used because of its long lifetime.

FIG. 1 illustrates an example of a partial structure of a three-electrode surface-discharge type AC plasma display panel.

A three-electrode surface-discharge type AC plasma display panel is comprised of a front substrate located closer to a viewer and a rear substrate located remoter from a viewer. The front substrate includes a plurality of sustaining electrodes (common electrodes) 101, and a plurality of scanning electrodes 102 both formed on a surface of the front substrate facing the rear substrate. A sustaining electrode 101 and a scanning electrode 102 located adjacent to the sustaining electrode 101 make a row-electrode pair acting as a one display-row. The rear substrate includes a plurality of column electrodes (address electrodes or data electrodes) formed on a surface thereof facing the front substrate. The column electrodes (not illustrated) extend perpendicularly to the row-electrode pair.

A plurality of display cells 103 are defined at intersections of the sustaining electrode 101 and the scanning electrode 102 with the column electrodes.

By applying a drive voltage across the column electrode and the scanning electrode 102, there is generated writing-discharge therebetween for selecting a display cell 103 from which light is emitted. Further, by applying a drive voltage between the sustaining electrode 101 and the scanning electrode 102 both of which make a column-electrode pair, there is generated sustaining-discharge comprised of surface-discharge in the selected display cell 103.

In a three-electrode surface-discharge type AC plasma display panel, highly energized ions generated when the surface-discharge is generated at the front substrate do not bombard and hence degrade a fluorescent material layer formed on the rear substrate, and hence, ensuring that a three-electrode surface-discharge type AC plasma display panel can have long lifetime.

In a three-electrode surface-discharge type AC plasma display panel, when a sustaining discharge (light-emission discharge) is to be generated, that is, during a sustaining-drive period, a high-frequency pulse or a drive pulse having a 100 to 500 KHz is applied across entirety of the sustaining electrodes 101 and the scanning electrodes 102.

As illustrated in FIG. 1, the sustaining electrodes 101 are electrically connected to one another through a bus electrode 104*a* extending along a left edge of a plasma display panel, and similarly, the scanning electrodes 102 are electrically connected to one another through a bus electrode 104*b* extending along a right edge of a plasma display panel.

Hence, a current caused by sustaining-drive and light-emission discharges flows at a time at one of the left and right edges of a plasma display panel.

FIG. 2 is an example of a cross-sectional view of a plasma display device.

As illustrated in FIG. 2, a first drive circuit 111 and a second drive circuit 112 are arranged at the rear of the plasma display panel 110. A ground (GND) plate 113 is sandwiched between the plasma display panel 110 and the first and second drive circuits 111 and 112.

In the plasma display panel 110 having the above-mentioned structure, when sustaining-drive and light-emission discharges are generated, a current flows in a forward direction A or a reverse direction B in a route defined by the first drive circuit 111, the ground plate 113, the second drive circuit 112 and the plasma display panel 110 connected to one another is this order. That is, when sustaining-drive and light-emission discharges are generated, there is formed a current loop 115 extending along the route, and the current loop 115 defines a loop antenna.

A current having a broadband frequency flowing through the loop antenna would cause quite intensive broadband electromagnetic radiation. Accordingly, it is necessary for a plasma display device to have an electromagnetic shield at an outer surface thereof for reducing such disadvantageous electromagnetic radiation.

Herein, attention is paid in particular to a relatively low frequency of a medium-wave band. A total length of the loop antenna is sufficiently shorter than a wavelength of a wavelength of such a medium-wave band. Hence, electromagnetic radiation caused when a high-frequency current flows in the loop antenna would have a property of magnetic field source, that is, leaked magnetic flux. Among leaked magnetic flux, a most intensive one is generated by drive pulses applied for generating light-emission discharge.

Since a plasma display device is required to be thin, it is necessary for such an electromagnetic shield as mentioned above to be arranged in the vicinity of a source of electromagnetic radiation. However, it is well known that a shield to a source of electromagnetic radiation is more difficult to fabricate, if the electromagnetic radiation has a lower frequency, or the shield has to be arranged closer to a source of electromagnetic radiation.

The shield is required to have superior performance. In order to accomplish such a shield having superior performance, it would be necessary for the shield to be composed of metal having high magnetic permeability and further having a sufficient thickness. However, a plasma display device including such a shield would be heavy and large in a size.

In particular, an optical filter attached to a surface of a display screen in a plasma display panel is required to have optical permeability and magnetic shield performance, resulting in that an optical filter would be very expensive.

For the reasons mentioned above, a conventional plasma display device cannot sufficiently reduce leaked magnetic flux in a medium-wave frequency band.

A so-called AM radio which receives medium radio-broadcasting waves is usually designed to have receipt sensitivity by means of a bar antenna composed of ferrite, and hence, is more likely to be influenced by induction of magnetic flux than electric field. Accordingly, when a user listens to an AM radio, if a frequency of radio-broadcasting waves is coincident or approximately coincident with any one of harmonics among frequencies of sustaining-drive pulses in a plasma display panel operating in the vicinity of the AM radio, the AM radio would be interfered by intensive electromagnetic waves derived from the plasma display panel. This results in that a user cannot properly listen to the AM radio.

That is, harmonics generated when a plasma display device is driven might cause electromagnetic interference to receipt of medium radio-casting waves. Such electromagnetic interference is caused not only in a house, but also in a plurality of houses such as a condominium in one of which a plasma display device is used.

A plasma display device is now broadly used, and accordingly, it is required that electromagnetic environment around a house in which a plasma display device is used is not deteriorated, and there is not caused electromagnetic interference to receipt of AM radio-broadcasting waves.

In order to meet such requirement, Japanese Patent Application Publication No. 2000-338932 has suggested a plasma display panel in which a frequency of a driving pulse, that is, a sustaining-drive frequency is successively varied with the lapse of time to prevent spectrum of radiation noise from concentrating to a specific frequency.

However, the suggested plasma display panel is accompanied with a problem as follows because of successive variance of a frequency of a drive pulse or successive modulation of a frequency of a drive pulse.

If a frequency of a driving pulse is successively varied with the lapse of time, harmonics having a common frequency are varied with the lapse of time together with the variance of the frequency of a driving pulse.

Hence, a condition in which a frequency of radio-broadcasting waves is coincident with any one of harmonics when a user listens to an AM radio in the vicinity of a plasma display panel, and a condition in which the frequency is not coincident with any one of harmonics are repeatedly caused with the lapse of time.

Thus, the plasma display panel suggested in the above-mentioned Publication can reduce interference to AM radio-broadcasting waves, but cannot completely prevent such interference.

For instance, in Japan, frequencies are applied to medium AM radio-broadcasting waves by every 9 KHz. An AM radio generally has a band-width of 10 KHz or greater for receiving radio-broadcasting waves. However, the plasma display panel suggested in the above-mentioned Publication periodically varies the sustaining-drive frequency within a limited range around a predetermined fixed frequency, and hence, there exist a plurality of radio-broadcasting waves which cause interference, in any one of regions in Japan.

Furthermore, harmonics radiated from a plasma display device would have an extended band-width due to the frequency modulation in the plasma display panel suggested in the above-mentioned Publication. Accordingly, possibility at which interference is caused to any one of AM radios broadcasting at various frequencies is increased.

SUMMARY OF THE INVENTION

In view of the above-mentioned problems in the conventional plasma display panels, it is an object of the present invention to provide a plasma display panel which is capable of reducing electromagnetic interference, for instance, to AM radio-broadcasting waves.

It is also an object of the present invention to provide a method of reducing such electromagnetic interference.

Hereinbelow is described a plasma display panel and a method of reducing electromagnetic interference both in accordance with the present invention through the use of reference numerals used in later described embodiments. The reference numerals are indicated only for the purpose of clearly showing correspondence between claims and the embodiments. It should be noted that the reference numerals are not allowed to use in the interpretation of claims of the present application.

In one aspect of the present invention, there is provided a plasma display device (1, 50) including a plasma display panel (20), and a driving pulse generator (21; 21, 31) which generates driving pulses for driving the plasma display panel (20), wherein the driving pulse generator (21; 21, 31) generates driving pulses each having a frequency identical with one of a plurality of predetermined frequencies.

The plasma display device may further include a memory (22) storing data necessary for generating the driving pulses each having a frequency identical with one of a plurality of predetermined frequencies, wherein the driving pulse generator (21; 21, 31) generates a pulse having a frequency selected from the plurality of predetermined frequencies, based on the data stored in the memory (22).

For instance, the memory (22) stores data necessary for generating the driving pulses each having an appropriate frequency associated with each of regions in which the plasma display device (1, 50) is used.

The appropriate frequency is selected as a frequency which reduces electromagnetic interference to medium or short radio-casting wave by electromagnetic wave.

For instance, the appropriate frequency is associated with regional data input into the plasma display device (1, 50) for identifying a region in which the plasma display device (1, 50) is used, and the driving pulse generator (21; 21, 31), on receipt of the regional data, determines a frequency of each of the driving pulses in accordance with the regional data.

The plasma display device may further include a data-inputting device (35) through which the regional data is input into the plasma display device.

For instance, the data-inputting device is comprised of a radio-signal remote-controller (35) for inputting the regional data into the plasma display device (1, 50) through radio-signals.

The plasma display device may further include a frequency-setter (23) through which a frequency of each of the driving pulses is determined, and the driving pulse generator (21; 21, 31) determines a frequency of each of the driving pulses in accordance with data input into the frequency-setter (23).

For instance, the frequency-setter is comprised of a switch (23).

As an alternative, the frequency-setter may be comprised of a radio-signal remote-controller (35).

In another aspect of the present invention, there is provided a method of reducing electromagnetic interference to radio-broadcasting waves by electromagnetic waves caused by a plasma display device comprising a plasma display panel (20), and a driving pulse generator (21; 21, 31) which generates driving pulses for driving the plasma display panel (20), the method comprising determining a frequency of each of the driving pulses to be equal to such a frequency that the electromagnetic interference is reduced, among a plurality of predetermined frequencies.

For instance, the frequency of each of the driving pulses is determined such that electromagnetic interference to medium or short radio-broadcasting waves is reduced.

The method may further include determining a plurality of frequencies of a pulse which can reduce the electromagnetic interference, for each of regions, and selecting an appropriate frequency among the frequencies in accordance with a region in which the plasma display device is used.

In still another aspect of the present invention, there is provided a program for causing a computer to carry out a method of reducing electromagnetic interference to radio-broadcasting waves by electromagnetic waves caused by a plasma display device comprising a plasma display panel (20), and a driving pulse generator (21; 21, 31) which generates driving pulses for driving the plasma display panel (20), wherein steps executed by the computer in accordance with the program include determining a frequency of each of the driving pulses to be equal to such a frequency that the electromagnetic interference is reduced, among a plurality of predetermined frequencies.

It is preferable that the frequency of each of the driving pulses is determined such that electromagnetic interference to medium or short radio-broadcasting waves is reduced.

It is preferable that the steps further include determining a plurality of frequencies of a driving pulse which can reduce the electromagnetic interference, for each of regions, and selecting an appropriate frequency among the frequencies in accordance with a region in which the plasma display device is used.

The advantages obtained by the aforementioned present invention will be described hereinbelow.

In accordance with the present invention, a frequency (sustaining-drive frequency) of a driving pulse generated by the driving pulse generator is selected from a plurality of predetermined frequencies. Accordingly, by selecting such a frequency that electromagnetic interference can be reduced, that is, by selecting a frequency such that electromagnetic interference to medium or short radio-broadcasting waves can be reduced in a profile of harmonics in the sustaining-drive frequency, it would be possible to reduce electromagnetic interference caused by a plasma display device.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

First Embodiment

A plasma display device 1 in accordance with the first embodiment is comprised of a three-electrode surface-discharge AC type plasma display panel 20, and a driver unit for driving the plasma display panel 20.

The plasma display panel 20 has the same structure as that of a conventional plasma display panel, and hence, is not explained in detail.

Figure 1:
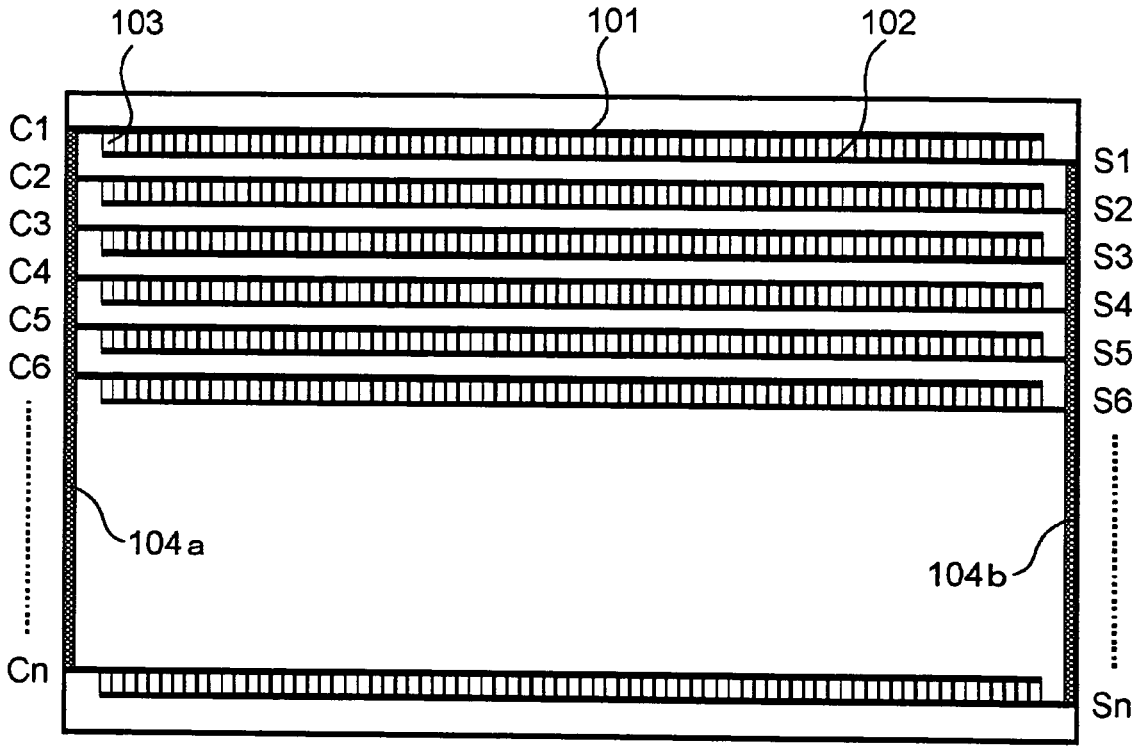
FIG.1 PRIOR ART
FIG. 1 illustrates an example of a partial structure of a three-electrode surface-discharge type AC plasma display panel.
Figure 2:
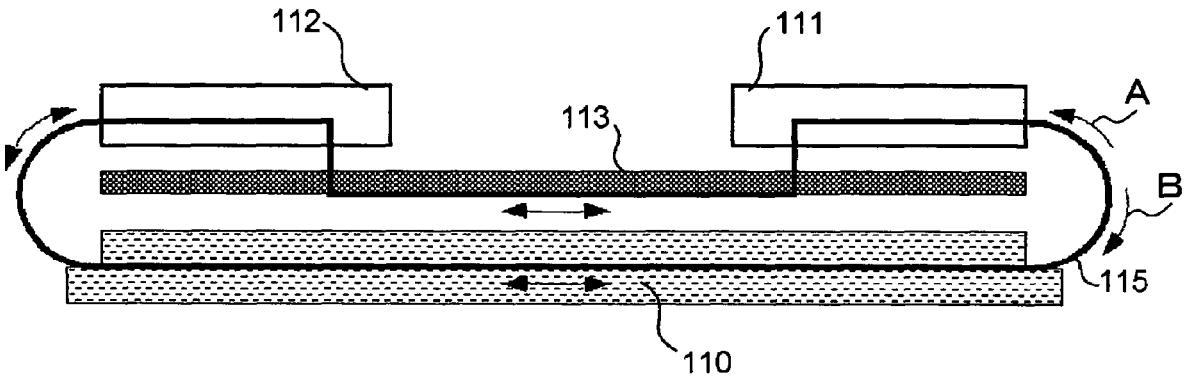
FIG.2 PRIOR ART
FIG. 2 is an example of a cross-sectional view of a plasma display device.
Figure 3:
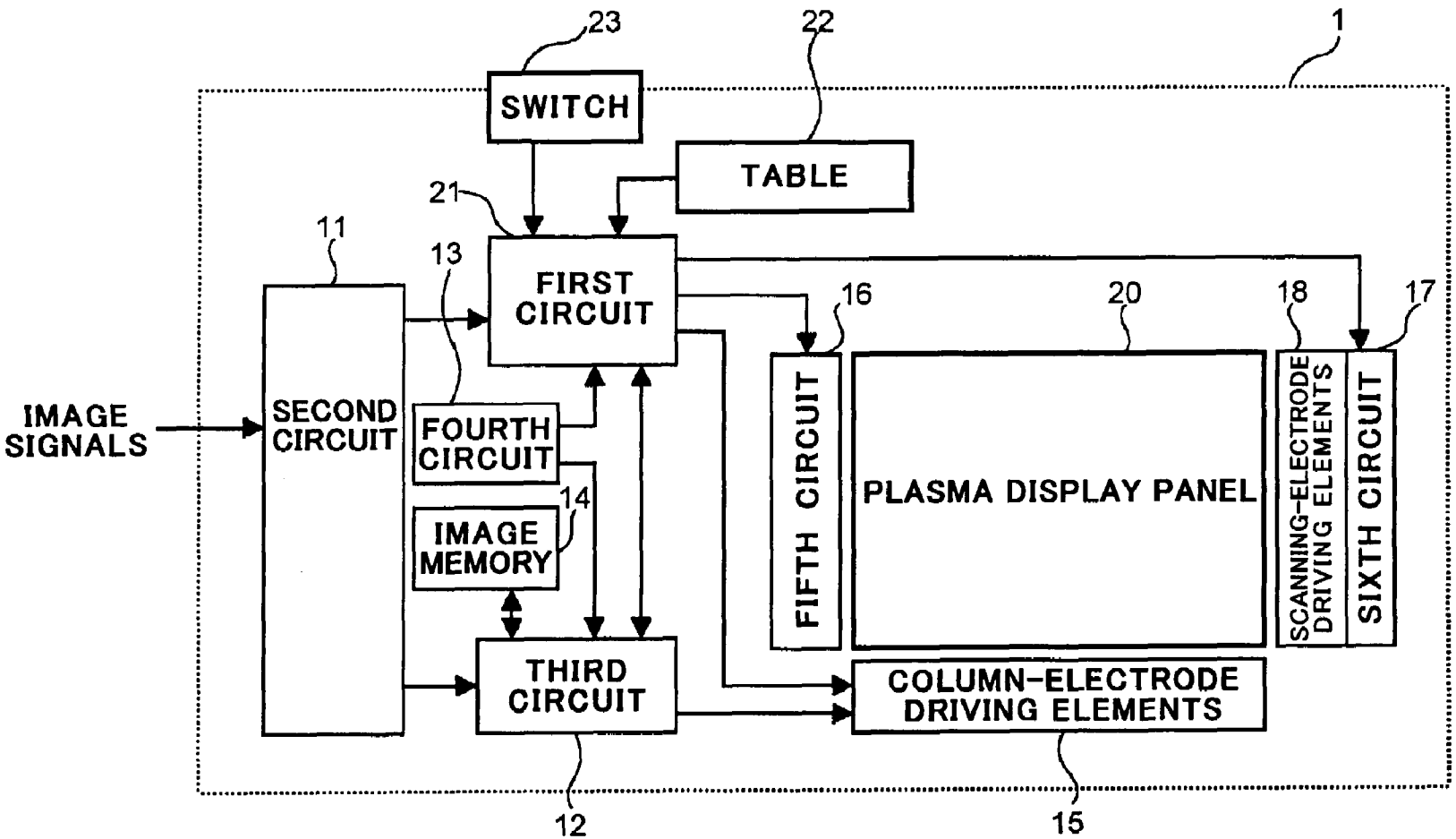
FIG. 3 is a block diagram of a plasma display device in accordance with the first embodiment of the present invention.

As illustrated in FIG. 3, the driver unit is comprised of a first circuit 21 for generating driving pulses in accordance with which the plasma display panel 20 is driven, a table 22 storing data necessary for the first circuit 21 to generate driving pulses, a switch 23 through which a sustaining-drive frequency of a driving pulse generated from the first circuit 21 is selected among a plurality of predetermined frequencies, a second circuit 11 for processing image signals, a third circuit 12 for processing digital image signals, a fourth circuit 13 for generating driving clock signals, an image memory 14, elements 15 for driving column electrodes, a fifth circuit 16 for driving the sustaining electrodes 101 (see FIG. 1), a sixth circuit 17 for driving the scanning electrodes 102 (see FIG. 1), and elements 18 for driving the scanning electrodes 102.

Writing step and sustaining-discharging step are repeatedly carried out to thereby drive the plasma display panel 20.

In the writing step, a voltage pulse is applied across the column electrodes and the scanning electrodes 102 to thereby generate writing discharge. As a result, wall charges are accumulated on the scanning electrodes 102 in the display cell 103 to thereby write an instruction of emitting light, into the display cell 103.

In the sustaining-discharging step, a sustaining pulse is applied alternately to the scanning electrode 102 or the sustaining electrode 101 subsequently to the writing step to thereby keep light-emission discharge only in the display cell 103 in which the wall charges are accumulated.

The column electrodes are driven by the column-electrode driving elements 15. The third circuit 12 and the first circuit 21 cooperate with each other to drive the column-electrodes driving elements 15.

The scanning electrodes 102 are driven by the scanning-electrode driving elements 18. The scanning-electrode driving elements 18 are controlled by the sixth circuit 17 operating under the control of the first circuit 21.

The sustaining electrodes 101 are driven by the fifth circuit 106 operating under the control of the first circuit 21.

The fourth circuit 13 generates driving clock signals having a fixed frequency, and transmits the driving clock signals to the third circuit 12 and the first circuit 21.

The first circuit 21 generates driving-control pulse signals, based on the driving clock signals received from the fourth circuit 13, and transmits the driving-control pulse signals to the fifth circuit 16, the sixth circuit 17 and the column-electrode driving elements 15.

The first circuit 21 further transmits timing signals to and receives timing signals from the third circuit 12, and controls transmission of image data to the column-electrode driving elements 15.

Sustaining-driving by which light-emission discharge is generated is carried out in accordance with the driving-control pulse signals transmitted to the fifth circuit 16 and the sixth circuit 17, and thus, a sustaining-driving frequency is determined.

The table 22 stores therein data necessary for the first circuit 21 to generate driving pulses having a plurality of predetermined sustaining-driving frequencies. The data stored in the table 22 includes a plurality of timing data necessary for generating driving pulses having the sustaining-driving frequencies, and each of the timing data is stored in the table 22 in association with each of the sustaining-driving frequencies. That is, the table 22 stores the timing data as a table for each of the sustaining-driving frequencies.

Among a plurality of the predetermined sustaining-driving frequencies, there is includes a sustaining-driving frequency or sustaining-driving frequencies which can avoid or reduce interference to medium AM radio-broadcasting waves.

In the first embodiment, the first circuit 21 is designed to be able to generate a driving pulse having a frequency selected from a first sustaining-driving frequency (200 KHz), a second sustaining-driving frequency (214 KHz) and a third sustaining-driving frequency (183 KHz). The table 22 stores timing data associated with the first to third sustaining-driving frequencies.

A sustaining-driving frequency of a driving pulse is selected among the first to third sustaining-driving frequencies through the switch 23. In other words, the first circuit 21 determined a sustaining-driving frequency in accordance with the selection made through the switch 23.

Specifically, the first circuit 21 reads one of the timing data out of the table 22 in association with the indication of the switch 23, and generates a driving pulse having a sustaining-driving frequency associated with the selected timing data. That is, the first circuit 21 generates a driving pulse having one of the sustaining-driving frequencies stored in the table 22.

Specifically, when the switch 23 indicates the first sustaining-driving frequency, the first circuit 21 reads the timing data associated with the first sustaining-driving frequency, out of the table 22, and generates a driving pulse having the first sustaining-driving frequency, based on the read-out timing data. Similarly, when the switch 23 indicates the second or third sustaining-driving frequency, the first circuit 21 reads the timing data associated with the second or third sustaining-driving frequency, out of the table 22, and generates a driving pulse having the second or third sustaining-driving frequency, based on the read-out timing data.

Thus, the first circuit 21 not only generates a driving pulse, but also selects a sustaining-driving frequency of a driving pulse. Specifically, the first circuit 21 selects a sustaining-driving frequency of a driving pulse among a plurality of the predetermined sustaining-driving frequencies. Then, the first circuit 21 generates a driving pulse having the selected sustaining-driving frequency.

The driving pulse is transmitted to the fifth circuit 16 and the sixth circuit 17 from the first circuit 21, and sustaining-driving is carried out at the sustaining-driving frequency of the drive pulse.

The switch 23 is exposed outside of the plasma display device 1. As an alternative, the switch 23 may be arranged on an outer surface of the plasma display device 1, and be covered with a cover designed rotatable relative to the plasma display device 1 by means of a hinge such that the cover is open to expose the switch 23 outside or closed to surround the switch 23 inside thereof.

Hereinbelow are explained the interference to medium AM radio-broadcasting waves, caused by leaked magnetic flux which generates while sustaining-driving of the plasma display device 1 is carried out, and the variance in the interference in accordance with a sustaining-driving frequency, with reference to FIGS. 4 to 6.

Since there does not exist a sustaining-driving frequency which does not interfere with any AM radio-broadcasting waves in Japan, hereinbelow are explained with respect to primary AM radio-broadcasting waves in a certain region in Japan.

Figure 4:
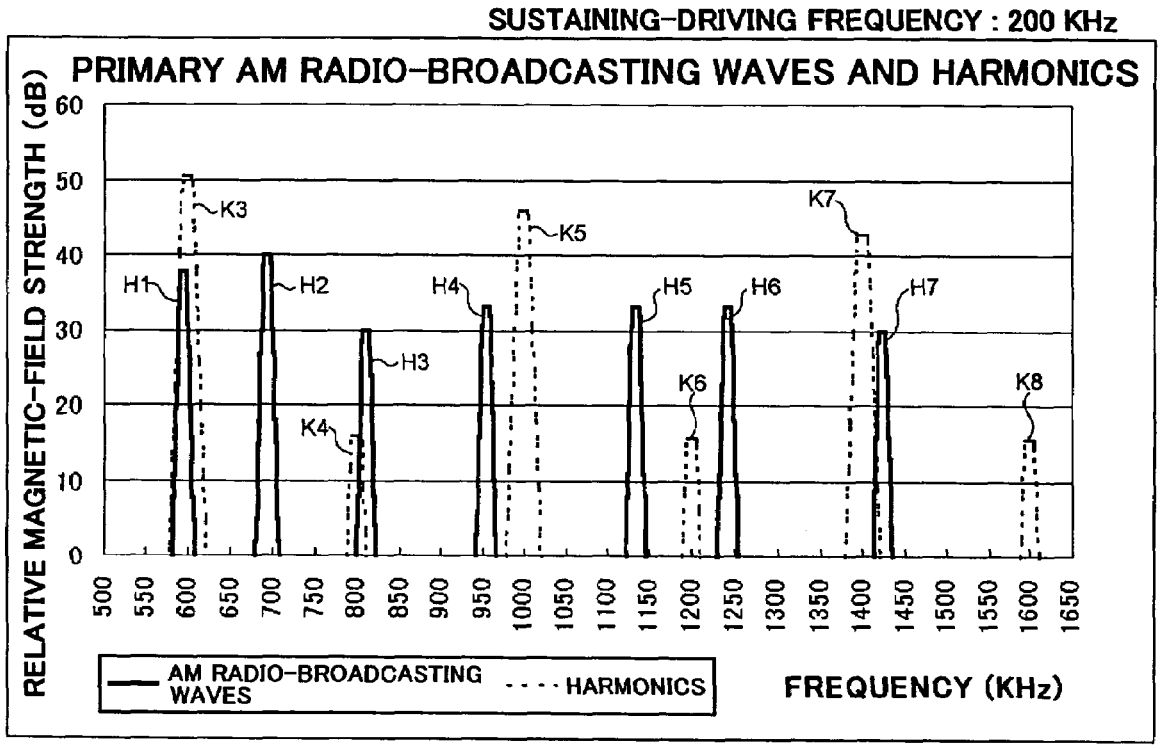
FIG. 4 illustrates a profile of spectrum of AM radio-broadcasting waves and harmonics generated when a driving pulse has a first sustaining-drive frequency.

FIG. 4 illustrates spectrum of harmonics generated in the vicinity of a plasma display device when the plasma display device is driven with a driving pulse having the above-mentioned first sustaining-driving frequency (200 KHz), and spectrum of AM radio-broadcasting waves. In FIG. 4, the spectrum of harmonics is illustrated with a broken line, and the spectrum of AM radio-broadcasting waves is illustrated with a solid line.

Herein, it is assumed that AM radio-broadcasting waves are comprised of first to seventh radio-broadcasting waves, and the first to seventh radio-broadcasting waves have spectrums H1 to H7, respectively.

Harmonics caused by sustaining-driving of the plasma display device 1 at the first sustaining-driving frequency (200 KHz) are comprised of third-order harmonics having spectrum K3 of 600 KHz, fourth-order harmonics having spectrum K4 of 800 KHz, fifth-order harmonics having spectrum K5 of 1000 KHz, sixth-order harmonics having spectrum K6 of 1200 KHz, seventh-order harmonics having spectrum K7 of 1400 KHz, and eighth-order harmonics having spectrum K8 of 1600 KHz.

As illustrated in FIG. 4, the spectrum K3 (600 KHz) of the third-order harmonics overlaps the spectrum H1 (594 KHz) of the first radio-broadcasting wave. As a result, it is quite difficult or almost impossible to receive the first radio-broadcasting wave through an AM radio, while the plasma display device 1 is in operation.

Even if an AM radio attempts to receive the seventh radio-broadcasting wave (1422 KHz), it would be quite difficult or almost impossible to receive the seventh radio-broadcasting wave through the AM radio, because the spectrum H7 of the seventh radio-broadcasting wave is quite close to the spectrum K7 (1400 KHz) of the seventh-order harmonics.

Similarly, even if an AM radio attempts to receive the third radio-broadcasting wave (810 KHz), it would be quite difficult or almost impossible to receive the third radio-broadcasting wave through the AM radio, because the spectrum H3 of the third radio-broadcasting wave is quite close to the spectrum K4 (800 KHz) of the seventh-order harmonics.

In FIG. 4, the M-th harmonics wherein M is an even number (that is, the fourth-order, sixth-order and eight-order harmonics) are lower in intensity than the N-th harmonics wherein N is an odd number (that is, the third-order, fifth-order and seventh-order harmonics). However, the M-th harmonics may cause electromagnetic interference to an AM radio in the vicinity of the plasma display device 1.

As mentioned above, in the example illustrated in FIG. 4, serious electromagnetic interference is caused when an AM radio receives the first, third or seventh radio-broadcasting waves.

Even so, a user can switch a sustaining-driving frequency of a driving pulse by which the plasma display device 1 is driven, to the second sustaining-driving frequency (214 KHz) from the first sustaining-driving frequency (200 KHz) through the switch 23 for reducing the electromagnetic interference, as follows.

Figure 5:
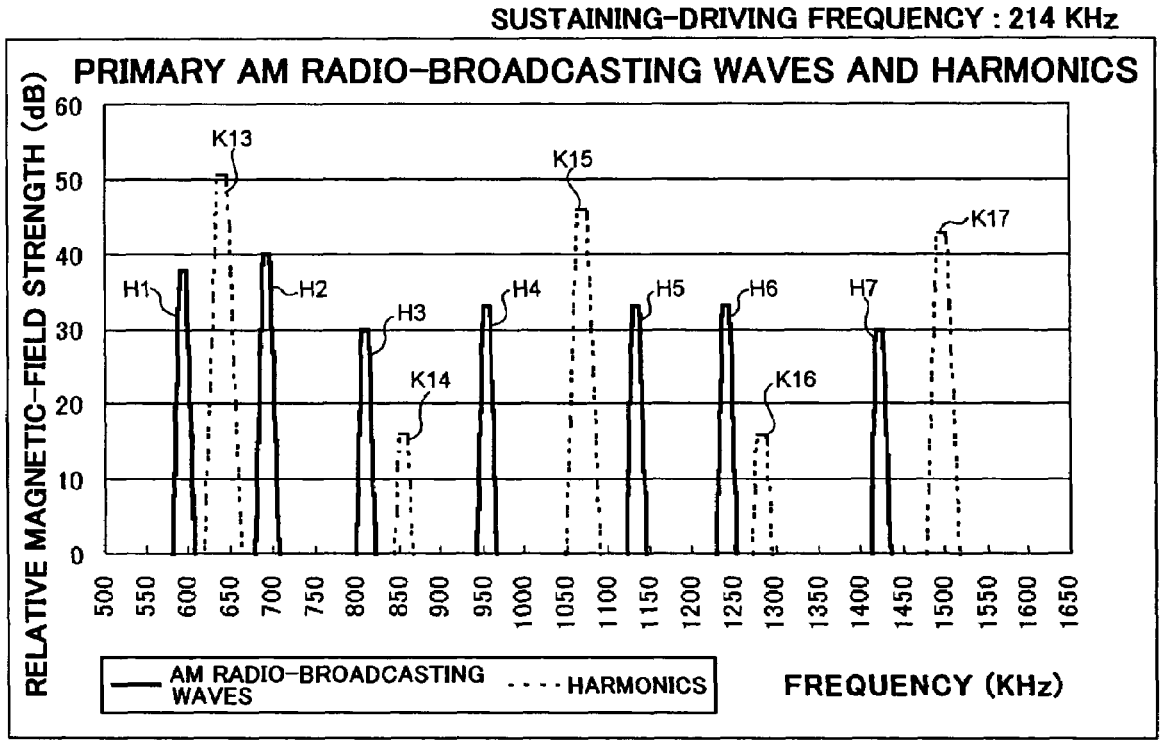
FIG. 5 illustrates a profile of spectrum of AM radio-broadcasting waves and harmonics generated when a driving pulse has a second sustaining-drive frequency.

FIG. 5 illustrates spectrum of harmonics generated in the vicinity of a plasma display device when the plasma display device is driven with a driving pulse having the above-mentioned second sustaining-driving frequency (214 KHz), and spectrum of AM radio-broadcasting waves. In FIG. 5, similarly to FIG. 4, the spectrum of harmonics is illustrated with a broken line, and the spectrum of AM radio-broadcasting waves is illustrated with a solid line.

In FIG. 5, the harmonics spectrums K13, K14, K15, K16 and K17 in a sustaining-driving frequency of the plasma display device 1 do not overlap and are not close to any one of the spectrums H1 to H7 of the first to seventh radio-broadcasting waves. Thus, it is possible to avoid electromagnetic interference to AM radio-broadcasting waves.

In the first embodiment, the first circuit 21 is set to generate a driving pulse having a sustaining-driving frequency selected from a plurality of the predetermined sustaining-driving frequencies, that is, the first to third sustaining-driving frequencies. The thus selected sustaining-driving frequency is capable of avoiding or reducing electromagnetic interference. Specifically, a sustaining-driving frequency of a driving pulse is determined so as to avoid or reduce electromagnetic interference to medium AM radio-broadcasting waves which interference is caused by harmonics included in the sustaining-driving frequency.

When a sustaining-driving frequency is varied to the second sustaining-driving frequency (214 KHz) from the first sustaining-driving frequency (200 KHz), the variance of the sustaining-driving frequency is just +7%. Hence, if the variance is taken into consideration in designing the plasma display device 1, there is no disadvantage in an operation of the plasma display device 1.

In the plasma display device 1 in accordance with the first embodiment, it is possible to reduce electromagnetic interference by setting a sustaining-driving frequency of the plasma display device 1 to be equal to the third sustaining-driving frequency (183 KHz), for instance.

Figure 6:
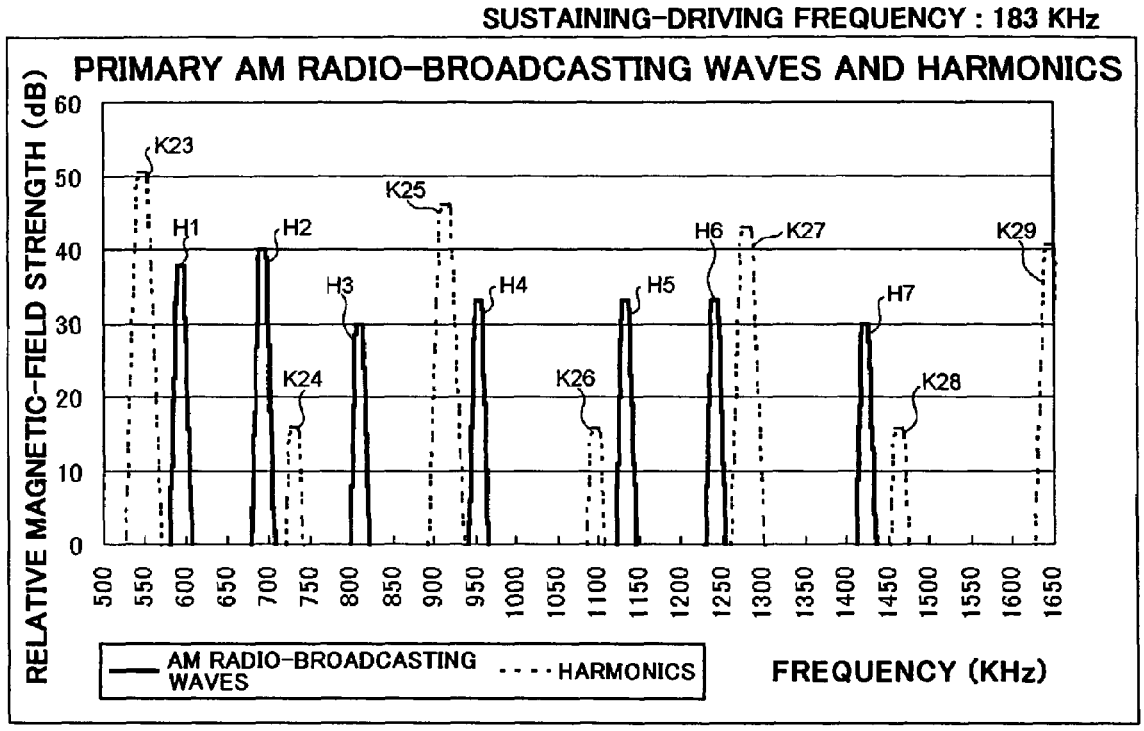
FIG. 6 illustrates a profile of spectrum of AM radio-broadcasting waves and harmonics generated when a driving pulse has a third sustaining-drive frequency.

FIG. 6 illustrates spectrum of harmonics generated in the vicinity of a plasma display device when the plasma display device is driven with a driving pulse having the above-mentioned third sustaining-driving frequency (183 KHz), and spectrum of AM radio-broadcasting waves. In FIG. 6, similarly to FIG. 4, the spectrum of harmonics is illustrated with a broken line, and the spectrum of AM radio-broadcasting waves is illustrated with a solid line.

In FIG. 6, the harmonics spectrums K23, K24, K25, K26, K27, K28 and K29 in a sustaining-driving frequency of the plasma display device 1 do not overlap and are not close to any one of the spectrums H1 to H7 of the first to seventh radio-broadcasting waves. Thus, it is possible to avoid electromagnetic interference to AM radio-broadcasting waves.

As mentioned above, there can be determined a plurality of sustaining-driving frequencies which can avoid interference to AM radio-broadcasting waves. For instance, two sustaining-driving frequencies, that is, the second and third sustaining-driving frequencies are determined in the first embodiment, in which case, the second sustaining-driving frequency (214 KHz) and the third sustaining-driving frequency (183 KHz) are found as a frequency which does not interfere with AM radio-broadcasting waves.

The table 22 stores timing data necessary for generating driving pulses having a sustaining-driving frequency which can avoid or reduce electromagnetic interference to AM radio-broadcasting waves in regions other than the region the spectrums in which are illustrated in FIGS. 4 to 6. Accordingly, it is possible to avoid or reduce electromagnetic interference in each of the regions by selecting the timing data associated with an appropriate frequency in each of the regions.

The table 22 stores timing data necessary for generating driving pulses having an appropriate sustaining-driving frequency in association with regions in each of which the plasma display device 1 is to be used. Herein, an appropriate sustaining-driving frequency means a sustaining-driving frequency of a driving pulse which can avoid or reduce electromagnetic interference to AM radio-broadcasting waves. A plurality of sustaining-driving frequencies which can avoid or reduce electromagnetic interference to AM radio-broadcasting waves may be determined for each of regions. A sustaining-driving frequency may be selected among the sustaining-driving frequencies in accordance with a region in which the plasma display device 1 is used.

In the first embodiment, a "region" is not to be limited to a region in Japan, and should be interpreted as including a region in countries other than Japan. In accordance with the above-mentioned first embodiment, it is possible to select an appropriate sustaining-driving frequency in accordance with each of regions in a country other than Japan.

As mentioned so far, in accordance with the first embodiment, a sustaining-driving frequency of a driving pulse generated from the first circuit 21 is selected from a plurality of the predetermined sustaining-driving frequencies. A plurality of sustaining-driving frequencies which can avoid or reduce electromagnetic interference to AM radio-broadcasting waves is calculated in advance for each of regions, and is stored in the table 22. An appropriate sustaining-driving frequency among the sustaining-driving frequencies is selected through the switch 23. Thus, it is possible to avoid or reduce electromagnetic interference to medium AM radio-broadcasting waves which interference is caused by leaked magnetic flux generated when the plasma display device 1 is in operation.

When there exists a plurality of primary AM radio-broadcasting waves in a certain region, frequencies of the AM radio-broadcasting waves are determined generally away from one another for avoiding interference among the AM radio-broadcasting waves.

Thus, it would be possible to avoid or reduce electromagnetic interference by determining a sustaining-driving frequency such that the harmonics in a sustaining-driving frequency of the plasma display device 1 are assigned to frequencies existing between the frequencies of the AM radio-broadcasting waves, as illustrated in FIGS. 5 and 6. In other words, it would be possible to avoid or reduce electromagnetic interference by determining a sustaining-driving frequency of a driving pulse such that harmonics in the sustaining-drive frequency have such a profile as avoiding or reducing electromagnetic interference to AM radio-broadcasting waves. As an alternative, it would be possible to avoid or reduce electromagnetic interference by determining a sustaining-driving frequency of a driving pulse not to interfere with any one of harmonics in the sustaining-driving frequency of the plasma display device 1.

The plasma display device 1 in accordance with the first embodiment does not carry out modulation of a frequency unlike the above-mentioned Japanese Patent Application Publication No. 2000-338932. Hence, it is possible to avoid an increase in a band-width of harmonics, ensuring that a possibility at which electromagnetic interference to AM radio-broadcasting waves having various frequencies is caused is not increased.

In the first embodiment, M-th and N-th harmonics wherein M is an even number and N is an odd number are referred to as harmonics in a sustaining-driving frequency causing electromagnetic interference. However, the M-th or N-th harmonics is more intensive than the other in dependence on waveforms of driving pulses or how the plasma display device 1 is driven, in which case, considering only the M-th or N-th harmonics as a sustaining-driving frequency causing electromagnetic interference, an appropriate sustaining-driving frequency, that is, a sustaining-driving frequency which can avoid or reduce electromagnetic interference may be calculated.

If all of the driving pulses generated from the first circuit 21 are allowed to vary, a sustaining-driving frequency may be switched to another one by directly varying a frequency of a driving clock signal transmitted from the fourth circuit 13.

As the switch 23, there may be used any type of a switch. The switch 23 may be designed to mechanically or electronically operate.

The plasma display device 1 may be designed to include a radio-signal remote controller such as an infra-red ray remote controller in place of the switch 23.

Second Embodiment

Figure 7:
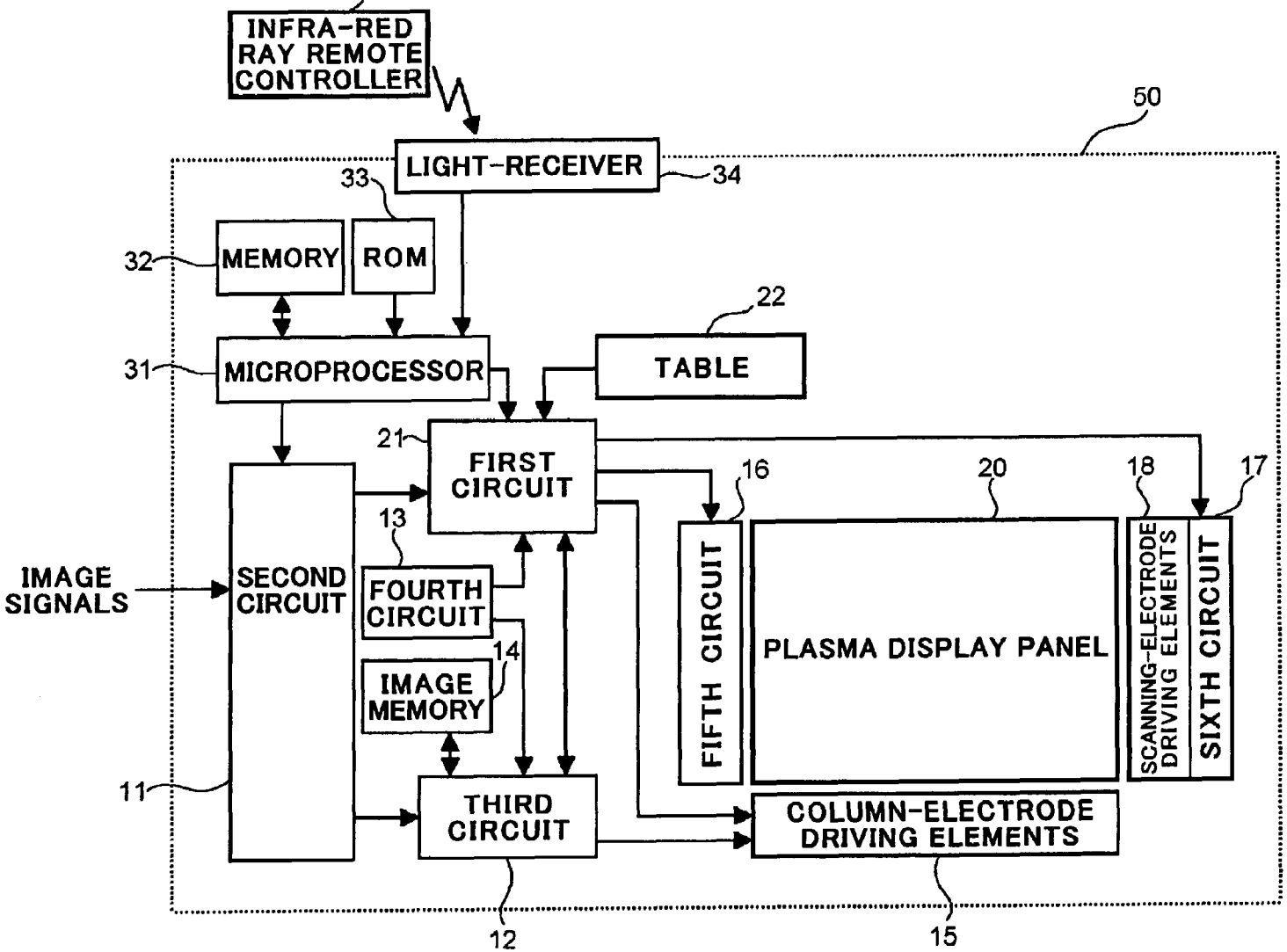
FIG. 7 is a block diagram of a plasma display device in accordance with the second embodiment of the present invention.

FIG. 7 is a block diagram of a plasma display device 50 in accordance with the second embodiment. Parts or elements that correspond to those of the plasma display device 1 illustrated in FIG. 3 have been provided with the same reference numerals, and operate in the same manner as corresponding parts or elements in the first embodiment, unless explicitly explained hereinbelow.

In comparison with the plasma display device 1 in accordance with the first embodiment, the plasma display device 50 in accordance with the second embodiment is designed not to include the switch 23, but to include a microprocessor 31, a memory 32, a read only memory (ROM) 33, a light-receiver 34, and an infra-red ray remote controller 35 as a radio-signal remote controller. The microprocessor 31, the memory 32, the read only memory (ROM) 33 and the light-receiver 34 are incorporated in a body of the plasma display device 50, and the infra-red ray remote controller 35 is separate from the body of the plasma display device 50.

The ROM 33 stores therein a program for driving the microprocessor 31. The microprocessor 31 reads the program out of the ROM 33, and executes the program. Thus, the microprocessor 31 operates in accordance with the program stored in the ROM 33.

The ROM 33 further stores data indicative of a plurality of predetermined sustaining-driving frequencies. Specifically, the ROM 33 stores therein data about a sustaining-driving frequency or sustaining-driving frequencies which can avoid or minimize electromagnetic interference to AM radio-broadcasting waves, for each of regions.

The infra-red ray remote controller 35 has not only a function of controlling a television set, but also a function of inputting regional data indicative of a region in which the plasma display device 50 is used, into the microprocessor 31 through the light-receiver 34.

Herein, the regional data may be comprised of any data identifying one region such as a regional code associated with each of regions, a zip code or an area code.

On receipt of the regional data from the infra-red ray remote controller 35 through the light-receiver 34, the microprocessor 31 stores the received regional data into the memory 32, and then, reads an appropriate sustaining-driving frequency associated with a region indicated in the received regional data, out of the ROM 33. Then, the microprocessor 31 transmits the appropriate sustaining-driving frequency to the first circuit 21.

On receipt of the sustaining-driving frequency from the microprocessor 31, the first circuit 21 reads timing data associated with the received sustaining-driving frequency, out of the table 22, and hereinafter, generates driving pulses having the sustaining-driving frequency associated with the timing data.

The regional data is input into the microprocessor 31 as follows, for instance.

A user starts an introduction menu in a display screen of the plasma display device 50 through the infra-red ray remote controller 35. The introduction menu includes a menu for inputting regional data. Viewing the menu in the display screen, a user can input the regional data into the microprocessor 31 through the infra-red ray remote controller 35.

For instance, the regional data is input into the microprocessor 31 when the plasma display device 50 is set up. Thus, an appropriate sustaining-driving frequency associated with a region in which the plasma display device 50 is set up can be selected for avoiding or minimizing electromagnetic interference to AM radio-broadcasting waves.

When a power supply in the plasma display device 50 is once turned off, and then, turned on, the microprocessor 31 reads regional data out of the memory 32, and further, reads a sustaining-driving frequency associated with the regional data out of the ROM 33, and then, transmits the sustaining-driving frequency to the first circuit 21. That is, even if the plasma display device 50 is repeatedly turned off and on, the plasma display device 50 is controlled to generate a driving pulse having the determined sustaining-driving frequency.

When the plasma display device 50 is move to an other region, regional data associated with a region into which the plasma display device 50 is moved is input into the microprocessor 31 through the infra-red ray remote controller 35.

As mentioned so far, the plasma display device 50 in accordance with the second embodiment makes it possible to determine an appropriate sustaining-driving frequency which avoids or minimizes interference to AM radio-broadcasting waves, merely by inputting regional data into the microprocessor 31 through the infra-red ray remote controller 35.

If regional data is comprised of data which a user can readily and soon know, such as a zip code or an area telephone code, it is not necessary for a user to inspect a regional code described in an instruction manual of the plasma display device 50.

In addition, since a user can input regional data into the microprocessor 31, viewing the introduction menu displayed in a display screen of the plasma display device 50, a user can surely do so without failure.

The microprocessor 31, the memory 32, the ROM 33, the light-receiver 34 and the infra-red ray remote controller 35 are usually equipped with a plasma display device. Hence, the plasma display device 50 can be fabricated at lower cost than the plasma display device 1 which has to additionally include the switch 23.

In the plasma display device 50 in accordance with the second embodiment, what is stored in the table 22 may be stored in the ROM 33 to thereby omit the table 22, in which case, the microprocessor 31, on receipt of regional data from the infra-red ray remote controller 35, reads timing data associated with the received regional data, out of the ROM 33, and transmits the timing data to the first circuit 21, which generates a driving pulse having a sustaining-driving frequency associated with the received timing data.

Since regional data is input into the microprocessor 31 through the infra-red ray remote controller 35, the plasma display device 50 is designed to include the light-receiver 34 through which regional data is input into the microprocessor 31 from the infra-red ray remote controller 35. As an alternative, regional data may be input into the microprocessor 31 through a wired remote controller electrically connected to the microprocessor 31 through a wire, in which case, the plasma display device 50 is not necessary to include the light-receiver 34. As an alternative, the plasma display device 50 may include a radio-signal type remote controller other than the infra-red ray remote controller 35.

In the second embodiment, it may be necessary to avoid or minimize electromagnetic interference to non-primary AM radio-broadcasting waves. Accordingly, it is preferable that an appropriate sustaining-driving frequency is determined not only based on regional data input into the microprocessor 31 from the infra-red ray remote controller 35, but also based on an instruction of a user.

The plasma display panels 1 and 50 in accordance with the first and second embodiments may be unitary or comprised of a plurality of units. For instance, the plasma display panel 20 and the driver unit for driving the plasma display panel 20 may be formed as separate parts.

In the above-mentioned first and second embodiments, the plasma display panels 1 and 50 are designed to be able to avoid or minimize electromagnetic interference to medium AM radio-broadcasting waves. The plasma display panels 1 and 50 may be designed to be able to avoid or minimize electromagnetic interference to short AM radio-broadcasting waves.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2003-128857 filed on May 7, 2003 including specification, claims, drawings and summary is incorporated herein by reference in its entirety.

What is claimed is:

1. A plasma display device comprising:

a plasma display panel; and a driving pulse generator which generates driving pulses for driving said plasma display panel, said driving pulse generator generating a driving pulse signal having a frequency identical with one of a plurality of predetermined frequencies, said driving pulse generator being configured so that said one frequency can be manually selected among said plurality of predetermined frequencies, wherein said plurality of predetermined frequencies are frequencies which reduce electromagnetic interference to medium or short radio-casting wave by electromagnetic waves.

2. The plasma display device as set forth in claim 1, further comprising a memory storing data representing signals having a frequency identical with one of a plurality of predetermined frequencies, and wherein said driving pulse generator generates a pulse signal having a frequency manually selected from said plurality of predetermined frequencies, based on said data stored in said memory.

3. The plasma display device as set forth in claim 2, wherein said driving pulse generator generates a pulse signal having an appropriate frequency associated with a piece of regional information which is manually supplied thereto.

4. The plasma display device as set forth in claim 3, wherein said appropriate frequency is a frequency which reduces electromagnetic interference to medium or short radio-casting wave by electromagnetic wave.

5. The plasma display device as set forth in claim 3, wherein said piece of regional information identifies a region in which said plasma display device is used.

6. The plasma display device as set forth in claim 3, further comprising a data-inputting device through radio-signals for transmitting said regional information to said driving pulse generator.

7. A method of reducing electromagnetic interference to radio-broadcasting waves by electromagnetic waves caused by a plasma display device having a plasma display panel, said method comprising:

determining a frequency; and driving said plasma display panel with a driving pulse signal having a frequency the same as the determined frequency, wherein said determined frequency reduces electromagnetic interference to medium or short radio-casting wave by electromagnetic waves.

8. The method as set forth in claim 7, wherein said frequency of each of said driving pulses is determined such that electromagnetic interference to medium or short radio-broadcasting waves is reduced.

9. The method as set forth in claim 8, further comprising:

determining a plurality of frequencies of a pulse which can reduce said electromagnetic interference, for each of regions; and selecting an appropriate frequency among said frequencies in accordance with a region in which said plasma display device is used.

10. A plasma display device comprising:

a plasma display panel; and a driving pulse generator which generates driving pulses for driving said plasma display panel, said driving pulse generator determining a frequency and generating a driving pulse having said frequency identical with one of a plurality of predetermined frequencies, and wherein said plurality of frequencies are frequencies which reduce electromagnetic interference to medium or short radio-casting wave by electromagnetic waves.

11. The plasma display device as set forth in claim 10, wherein said plurality of frequencies are associated with a piece of regional information for identifying a region in which said plasma display device is used, and said driving pulse generator, on receipt of said regional information, determines a frequency in accordance with said regional information.

* * * * *